US011142947B1

(12) United States Patent
Zhang

(10) Patent No.: US 11,142,947 B1
(45) Date of Patent: Oct. 12, 2021

(54) ADJUSTABLE ROLLER SHADES

(71) Applicant: Jiwen Zhang, Nanyang (CN)

(72) Inventor: Jiwen Zhang, Nanyang (CN)

(73) Assignee: Nanyang Kunyuan Intelligent Technology Co., Ltd., Nanyang (CN)

( * ) Notice: Subject to any disclaimer, the term of this patent is extended or adjusted under 35 U.S.C. 154(b) by 0 days.

(21) Appl. No.: 17/316,974

(22) Filed: May 11, 2021

(51) Int. Cl.

| | |
|---|---|
| ***E06B 9/64*** | (2006.01) |
| ***E06B 9/42*** | (2006.01) |
| ***E06B 9/70*** | (2006.01) |
| ***E06B 9/74*** | (2006.01) |
| *E06B 9/68* | (2006.01) |

(52) U.S. Cl.
CPC ..... *E06B 9/64* (2013.01); *E06B 9/42* (2013.01); *E06B 9/70* (2013.01); *E06B 9/74* (2013.01); *E06B 2009/6809* (2013.01)

(58) Field of Classification Search
CPC ..... E06B 9/64; E06B 9/56; E06B 9/42; E06B 9/70; E06B 9/74; E06B 2009/6809; E06B 2009/785
USPC ..... 160/319, 320, 242, 243, 244, 253, 254
See application file for complete search history.

(56) References Cited

U.S. PATENT DOCUMENTS

| | | | | | |
|---|---|---|---|---|---|
| 204,375 | A * | 5/1878 | Reynolds | E06B 9/54 | 160/99 |
| 219,110 | A * | 9/1879 | Nissley | E06B 9/42 | 160/256 |
| 356,369 | A * | 1/1887 | Mitchell | E06B 9/42 | 160/256 |
| 520,863 | A * | 6/1894 | Reilly | E06B 9/64 | 160/253 |
| 1,040,798 | A * | 10/1912 | Smith | E06B 9/42 | 160/256 |
| 1,157,261 | A * | 10/1915 | Staats | E06B 9/64 | 160/253 |
| 1,954,076 | A * | 4/1934 | Gardner | E06B 9/42 | 160/256 |
| 2015/0034261 | A1* | 2/2015 | Lang | E06B 9/64 | 160/319 |

* cited by examiner

*Primary Examiner* — Catherine A Kelly
*Assistant Examiner* — Jeremy C Ramsey
(74) *Attorney, Agent, or Firm* — Ming Jiang; MM IP Services LLC

(57) ABSTRACT

Present disclosure relates to several adjustable roller shades. Adjustable roller shade includes: roller shade fabric winding shaft, weight, movable pulley, traction rope, and a pair of winders. A roller shade fabric is wound on roller shade fabric winding shaft 1 forming upper edge of adjustable roller shade. Weight is attached to bottom of roller shade fabric forming lower edge of adjustable roller shade. Movable pulley is fixedly attached to one end of the roller shade fabric winding shaft. The traction rope is wound around the movable pulley and pair of winders and pair of tensioning wheels. One or more driving motors drive the pair of winders to rotate in different combination of directions to raise or lower both upper edge and lower edge of adjustable roller shade, resulting the adjustable roller shade to be opened or closed freely from both upper and lower edges of the adjustable roller shade.

7 Claims, 10 Drawing Sheets

ADJUSTABLE ROLLER SHADES

FIELD

The invention relates to a window covering, in particular to adjustable roller shades to be freely opened and closed both from top and/or bottom.

BACKGROUND

The roller shade is convenient to use, attractive and elegant, and is widely used both in homes and office environments. The roller shades currently on the market is generally mounted at the top of the window, using a scroll to roll up and down to open the roller shades from the bottom. When such roller shades are opened partially, the lower portion of the room is exposed and natural light from the upper portion is blocked.

It is desirable to have a roller shade that can open a lower portion, an upper portion, or both lower and upper portion of the window to meet user's needs to open any portion of the window.

Therefore, an unaddressed need exists in the art to address the aforementioned deficiencies and inadequacies.

SUMMARY

In one aspect, the present disclosure relates to an adjustable roller shade. In certain embodiments, the adjustable roller shade includes: a roller shade fabric winding shaft, a weight, a movable pulley, a pair of traction ropes, a set of winders. In certain embodiments, a roller shade fabric is wound on the roller shade fabric winding shaft forming an upper edge of the adjustable roller shade. The weight is attached to a bottom of the roller shade fabric forming a lower edge of the adjustable roller shade. The movable pulley is fixedly attached to the roller shade fabric winding shaft. The pair of traction ropes is wound around the movable pulley. The pair of traction ropes includes an upward lifting rope, and a downward pulling rope. Each of the upward lifting rope and the downward pulling rope includes a first end and a second end.

In certain embodiments, the set of winders includes: a first winder, a second winder, a third winder, and a fourth winder. The first winder and the second winder are used to wind a first end and a second end of the upward lifting rope, respectively, and the third winder and the fourth winder are used to wind a first end and a second end of the downward pulling rope, respectively. The set of winders rotates in concert to adjust the upper edge and the lower edge of the of the adjustable roller shade.

In certain embodiments, each of the set of winders is driven by a driving motor independently, and the driving motors are controlled by a controller. The controller receives control commands from a control device, and the control device includes: a manual control device, a control switch, and a remote control. In certain embodiments, the pair of traction ropes includes one of: a rope, a bead chain, and a belt.

In certain embodiments, when the first winder and the third winder rotate clockwise, and the second winder and the fourth winder rotate counter-clockwise, the upper edge of the adjustable roller shade rises. When the first winder and the third winder rotate counter-clockwise, and the second winder and the fourth winder rotate clockwise, the upper edge of the adjustable roller shade lowers. When the first winder, the second winder, the third winder and the fourth winder rotate clockwise, the lower edge of the adjustable roller shade lowers. When the first winder, the second winder, the third winder and the fourth winder rotate counter-clockwise, the lower edge of the adjustable roller shade rises.

In certain embodiments, the second end of the upward lifting rope is fixedly attached to an upward lifting rope fixed point and the second end of the downward pulling rope is fixedly attached to a downward pilling rope fixed point. The movable pulley is fixedly attached to an axial and a driving motor is installed on the axial to drive the roller shade fabric winding shaft to rotate clockwise to lower the lower edge of the adjustable roller shade, and to drive the roller shade fabric winding shaft to rotate counter-clockwise to raise the lower edge of the adjustable roller shade.

In certain embodiments, when the first winder and the third winder rotate clockwise, the second ends of the upward lifting rope and the downward pulling rope remain stationary, the upper edge of the adjustable roller shade rises. When the first winder and the third winder rotate counter-clockwise, the second ends of the upward lifting rope and the downward pulling rope remain stationary, the upper edge of the adjustable roller shade lowers. When the driving motor rotates clockwise, the driving motor drives the roller shade fabric winding shaft clockwise, the lower edge of the adjustable roller shade lowers. When the driving motor rotates counter-clockwise, the driving motor drives the roller shade fabric winding shaft counter-clockwise, the lower edge of the adjustable roller shade rises.

In another aspect, the present disclosure relates to an adjustable roller shade. In certain embodiments, the adjustable roller shade includes: a roller shade fabric winding shaft, a weight, a movable pulley, a traction rope, and a pair of winders. A roller shade fabric is wound on the roller shade fabric winding shaft forming an upper edge of the adjustable roller shade. The weight is attached to a bottom of the roller shade fabric forming a lower edge of the adjustable roller shade. The movable pulley is fixedly attached to a first end of the roller shade fabric winding shaft. The traction rope is wound around the movable pulley. The traction rope includes an upward lifting section, a first connecting section, a downward pulling section, and a second connecting section forming a closed loop. The pair of winders includes a first winder, and a second winder. The upward lifting section goes from the first winder, over the movable pulley, and to the second winder, the downward pulling section goes from a second tensioning wheel, over the movable pulley, and to a first tensioning wheel, the first connecting section connects a first end of the upward lifting section to a first end of the downward pulling section, and the second connecting section connects a second end of the downward pulling section to a second end of the upward lifting section.

In certain embodiments, the traction rope includes one of: a rope, a bead chain, and a belt. Each of the pair of winders is driven by a driving motor independently, and the driving motors are controlled by a controller. The controller receives control commands from a control device, and the control device includes: a manual control device, a control switch, and a remote control. In certain embodiments, the manual control device includes a first bead chain linked to the first winder, and a second bead chain linked to the second winder. The first bead chain includes: a first upward lifting section, a first downward pulling section, and the second bead chain includes: a second upward lifting section, and a second downward pulling section.

In certain embodiments, when the first winder rotates clockwise, and the second winder rotates counter-clockwise, the upper edge of the adjustable roller shade lowers; when the first winder rotates counter-clockwise, and the second winder rotates clockwise, the upper edge of the adjustable roller shade rises; when the first winder and the second winder rotate clockwise, the lower edge of the adjustable roller shade lowers; and when the first winder and the second winder rotate counter-clockwise, the lower edge of the adjustable roller shade rises.

In certain embodiments, a second movable pulley is fixedly attached to a second end of the roller shade fabric winding shaft, a second traction rope goes through a second pair of winders and a pair of tensioning wheels on the second end of the roller shade fabric winding shaft, both movable pulleys, two pairs of winders, and two pairs of tensioning wheels are installed in two guide grooves located on each end of the roller shade fabric winding shaft, symmetrically to maintain balance of the adjustable roller shade, and a first driving motor and a second driving motor are installed on one side of the guide grooves, the second pair of winders are driven by a pair of transmission rods.

In yet another aspect, the present disclosure relates to an adjustable roller shade. In certain embodiments, the adjustable roller shade includes: a roller shade fabric winding shaft, a weight, a movable pulley, a traction rope, and a pair of winders. A roller shade fabric is wound on the roller shade fabric winding shaft forming an upper edge of the adjustable roller shade. The weight is attached to a bottom of the roller shade fabric forming a lower edge of the adjustable roller shade. The movable pulley is fixedly attached to a first end of the roller shade fabric winding shaft. The traction rope is wound around the movable pulley. The traction rope includes an upward lifting section, a first connecting section, a downward pulling section, and a second connecting section forming a closed loop. The pair of winders includes a first winder, and a second winder. A first end of the upward lifting section goes from the first winder, over the movable pulley, and to the second winder, connects a first end of the downward pulling section, goes around a second tensioning wheel, connects to a first end of the first connecting section, goes over the movable pulley, connects to a first end of the second connecting section around the first tensioning wheel, and connects the first end of the upward lifting section, forming a complete loop.

In certain embodiments, the traction rope includes one of: a rope, a bead chain, and a belt. The pair of winders are driven by a driving gear set and a clutch device. The driving gear set and the clutch device are controlled by a controller. The controller receives control commands from a control device, and the control device includes: a manual control device, a control switch, and a remote control.

In certain embodiments, when the first winder is disengaged with the clutch device, and when the second winder is driven to rotates clockwise by the driving gear set through the clutch device, the upper edge of the adjustable roller shade lowers. When the first winder is disengaged with the clutch device, and when the second winder is driven to rotates counter-clockwise by the driving gear set through the clutch device, the upper edge of the adjustable roller shade rises.

In certain embodiments, when the first winder is engaged with the clutch device, and when the second winder is driven to rotates clockwise by the driving gear set through the clutch device, the first winder also rotates clockwise causing the roller shade fabric winding shaft to rotate clockwise, and the lower edge of the adjustable roller shade lowers. When the first winder is engaged with the clutch device, and when the second winder is driven to rotates counter-clockwise by the driving gear set through the clutch device, the first winder also rotates counter-clockwise causing the roller shade fabric winding shaft to rotate counter-clockwise, and the lower edge of the adjustable roller shade rises.

In certain embodiments, when the first winder is disengaged with the clutch device, and when the second winder is driven to rotates clockwise by the driving gear set through the clutch device, the upper edge of the adjustable roller shade lowers. When the first winder is disengaged with the clutch device, and when the second winder is driven to rotates counter-clockwise by the driving gear set through the clutch device, the upper edge of the adjustable roller shade rises.

In certain embodiments, when the first winder is engaged with the clutch device, and when the second winder is driven to rotates clockwise by the driving gear set through the clutch device, the first winder also rotates clockwise causing the roller shade fabric winding shaft to rotate clockwise, and the lower edge of the adjustable roller shade lowers. When the first winder is engaged with the clutch device, and when the second winder is driven to rotates counter-clockwise by the driving gear set through the clutch device, the first winder also rotates counter-clockwise causing the roller shade fabric winding shaft to rotate counter-clockwise, and the lower edge of the adjustable roller shade rises.

In certain embodiments, a second movable pulley is fixedly attached to a second end of the roller shade fabric winding shaft, a second traction rope goes through a second pair of winders and a pair of tensioning wheels on the second end of the roller shade fabric winding shaft, both movable pulleys, two pairs of winders, and two pairs of tensioning wheels are installed in two guide grooves located on each end of the roller shade fabric winding shaft, symmetrically to maintain balance of the adjustable roller shade, and the driving gear set and the clutch device are installed on one side of the guide grooves, the second pair of winders are driven by a pair of transmission rods.

These and other aspects of the present disclosure will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the disclosure and, together with the written description, serve to explain the principles of the disclosure. Wherever possible, the same reference numbers are used throughout the drawings to refer to the same or like elements of an embodiment. The drawings do not limit the present disclosure to the specific embodiments disclosed and described herein. The drawings are not necessarily to scale, emphasis instead being placed upon clearly illustrating the principles of the disclosure, and wherein.

DETAILED DESCRIPTION

Figure 1:
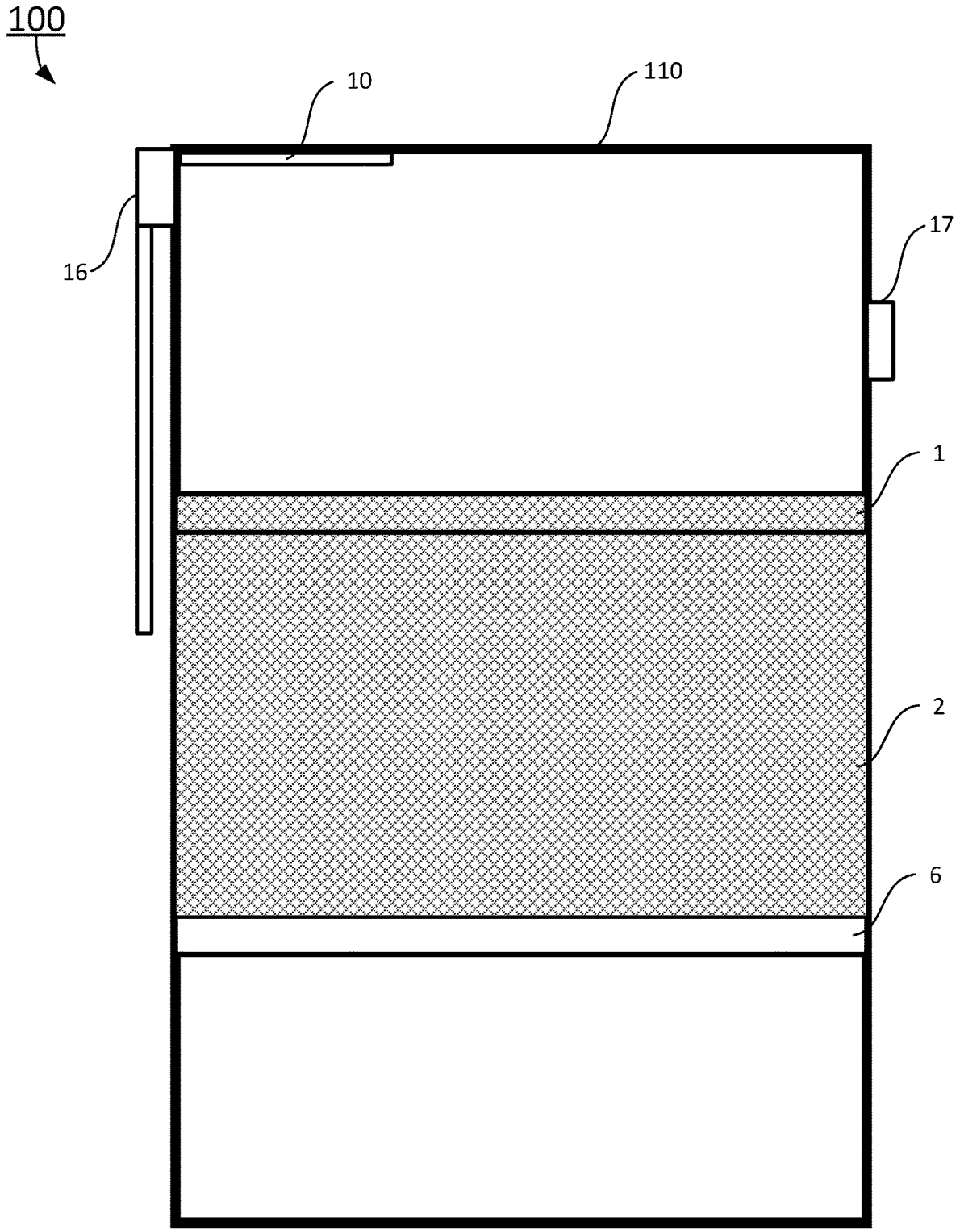
FIG. 1 is a schematic structural view of an exemplary adjustable roller shade according to certain embodiments of the present disclosure.

The present disclosure will now be described more fully hereinafter with reference to the accompanying drawings, in which exemplary embodiments of the disclosure are shown. This disclosure may, however, be embodied in many different forms and should not be construed as limited to the embodiments set forth herein. Rather, these embodiments are provided so that this disclosure will be thorough and complete, and will fully convey the scope of the disclosure to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximates, meaning that the term "around", "about" or "approximately" can be inferred if not expressly stated.

Many specific details are provided in the following descriptions to make the present disclosure be fully understood, but the present disclosure may also be implemented by using other manners different from those described herein, so that the present disclosure is not limited by the specific embodiments disclosed in the following.

The description will be made as to the embodiments of the present disclosure in conjunction with the accompanying drawings FIGS. 1 through 10.

The present disclosure will now be described more fully hereinafter with reference to the accompanying drawings, in which exemplary embodiments of the disclosure are shown. This disclosure may, however, be embodied in many different forms and should not be construed as limited to the embodiments set forth herein. Rather, these embodiments are provided so that this disclosure will be thorough and complete, and will fully convey the scope of the disclosure to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximates, meaning that the term "around", "about" or "approximately" can be inferred if not expressly stated.

Many specific details are provided in the following descriptions to make the present disclosure be fully understood, but the present disclosure may also be implemented by using other manners different from those described herein, so that the present disclosure is not limited by the specific embodiments disclosed in the following.

The description will be made as to the embodiments of the present disclosure in conjunction with the accompanying drawings FIGS. 1 through 10.

Figure 2:
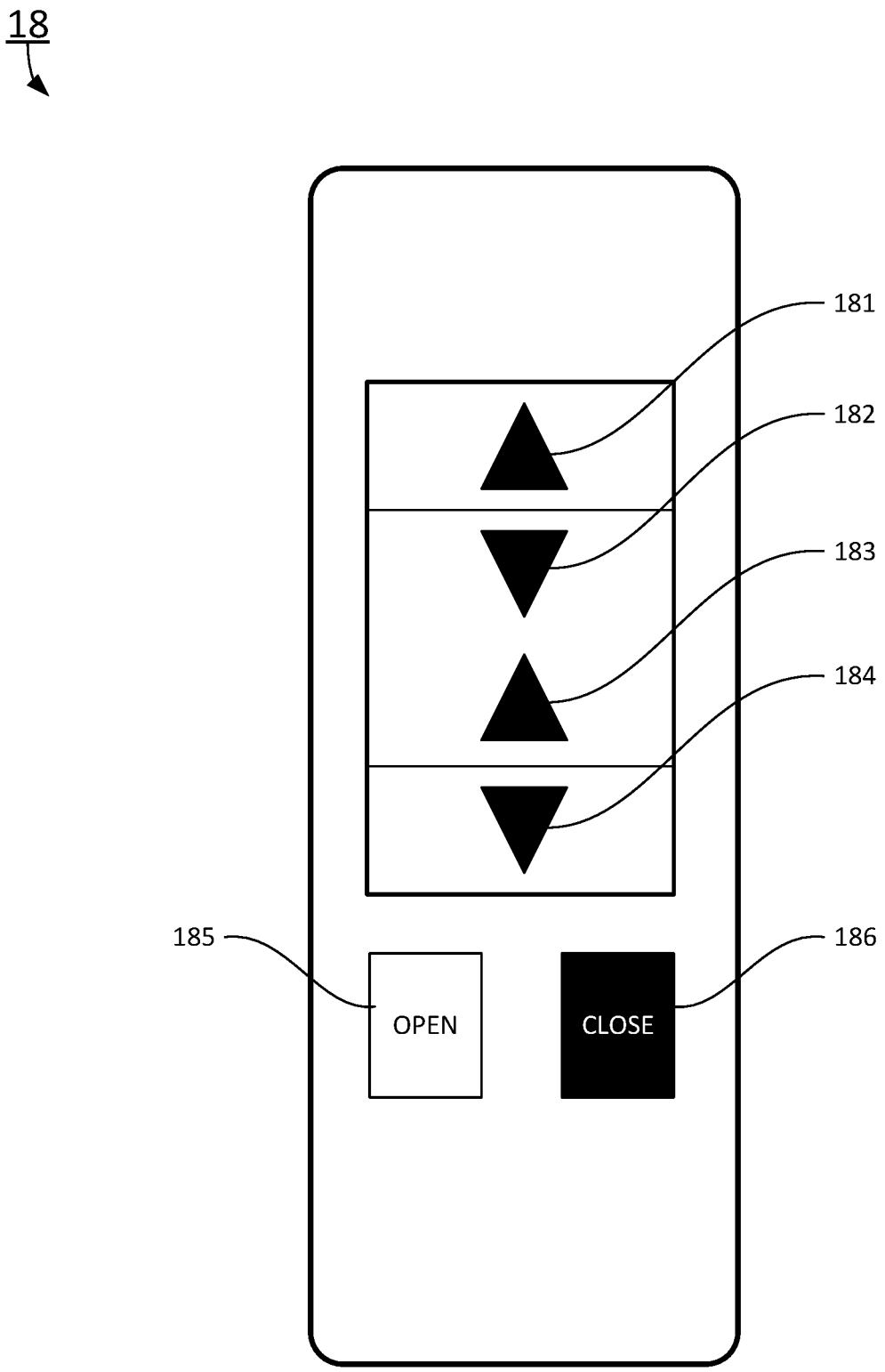
FIG. 2 is a front view of a remote control for controlling the adjustable roller shade according to certain embodiments of the present disclosure.

As shown in FIG. 1, an adjustable roller shade 100 is installed on a window 110. The adjustable roller shade 100 has a roller shade fabric winding shaft 1 where a roller shade fabric 2 is rolled around the roller shade fabric winding shaft 1 to form an upper edge of the adjustable roller shade 100. A weight 6 is attached to a bottom of the roller shade fabric 2 to keep the roller shade fabric 2 straight and to form a lower edge of the adjustable roller shade 100. The present disclosure describes a few exemplary embodiments of such adjustable roller shades 100, 200, and 300 where the upper edge of the adjustable roller shade and the lower edge of the adjustable roller shade 100 may be adjusted according to users' desires and have the flexibilities of opening the roller shade at a top portion, a bottom portion, or both top portion and bottom portion of the window 110. The adjustable roller shade 100 can be controlled by a manual control device 16, a control switch 17, and a remote control 18 as shown in FIG. 2. The upper edge and the lower edge of the adjustable roller shade 100 may be independently adjusted, and simultaneously adjusted. In certain embodiments, the remote control 18 has four directional control buttons: an up button 181 and a down button 182 for controlling the upper edge of the adjustable roller shade 100, and an up button 183 and a down button 184 for controlling the lower edge of the adjustable roller shade 100. These buttons can be pressed at the same time to cause simultaneous movements of the adjustable roller shade 100. Remote control 18 also has a one-key open button 185, and one-key close button 186 to open or close the adjustable roller shade 100 completely by pressing only one key.

Figure 3:
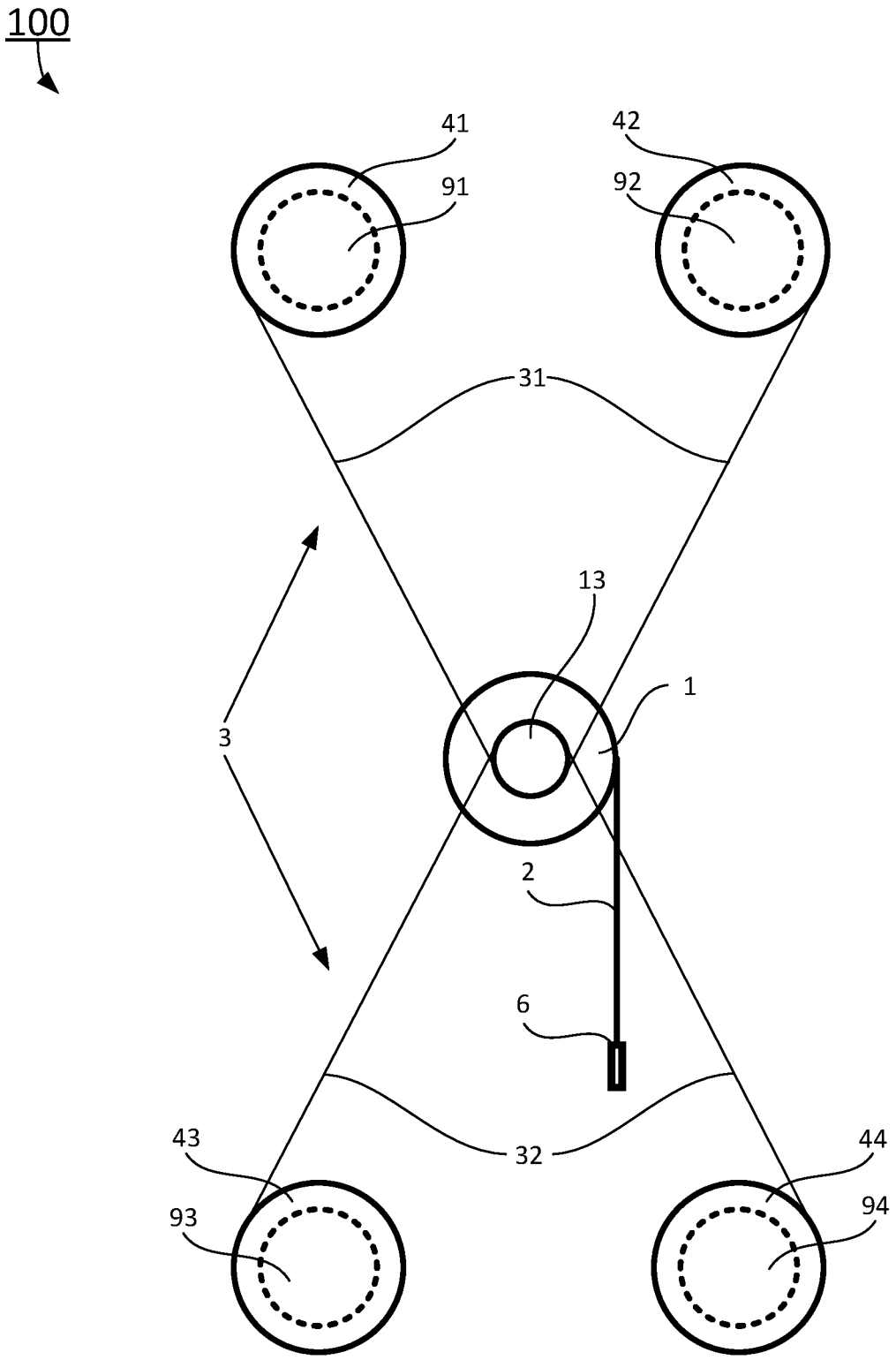
FIG. 3 illustrates an exemplary adjustable roller shade having two traction ropes according to one embodiment of the present disclosure.
Figure 4:
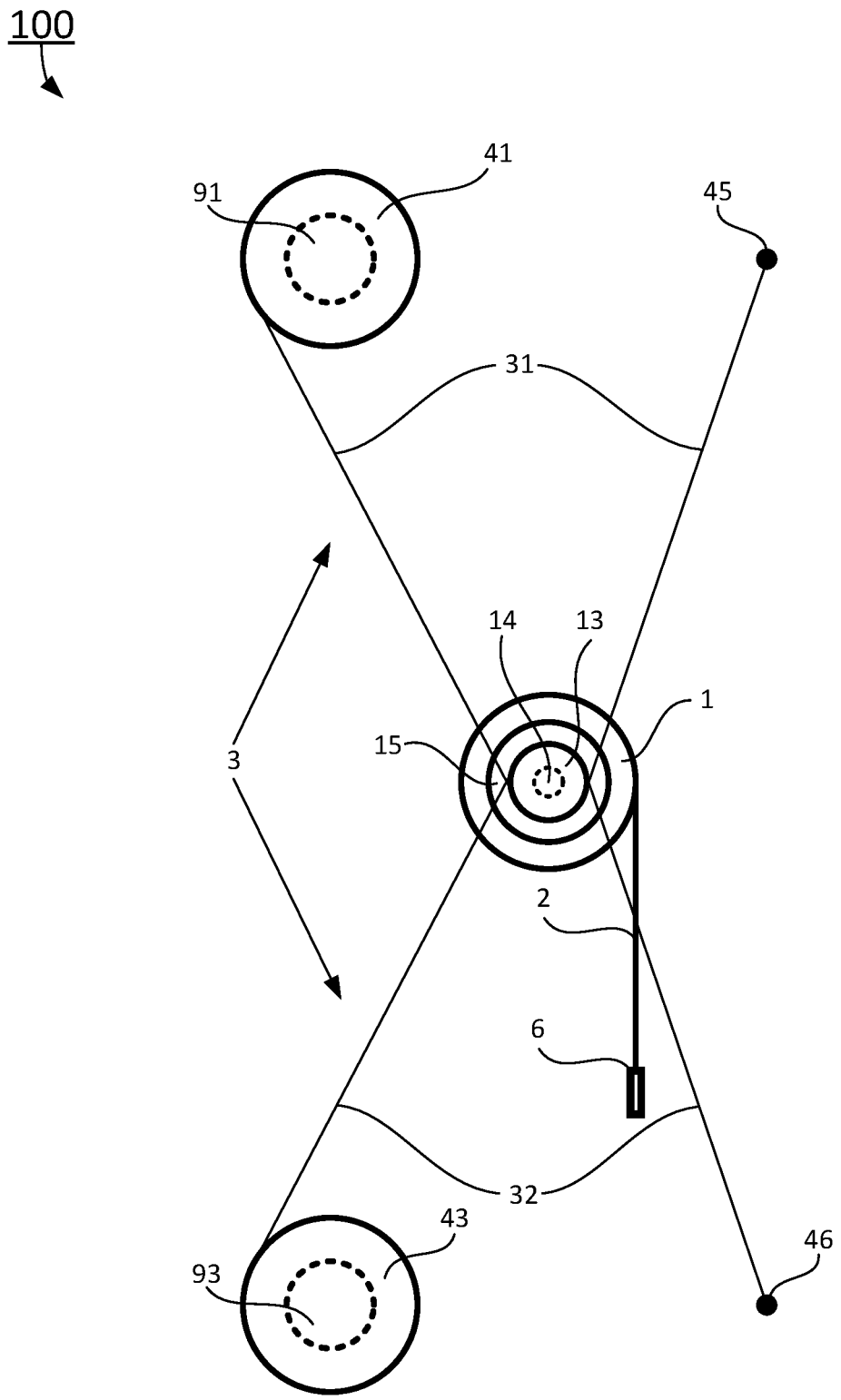
FIG. 4 illustrates an exemplary adjustable roller shade having two traction ropes according to another embodiment of the present disclosure.

In one aspect, as shown in FIGS. 3-4, the present disclosure relates to an adjustable roller shade 100. In one embodiment, as shown in FIG. 3, the adjustable roller shade 100 includes: a roller shade fabric winding shaft 1, a weight 6, a movable pulley 13, a pair of traction ropes 3, and a set of winders. The pair of traction ropes 3 includes an upward lifting rope 31 and a downward pulling rope 32. The set of winders includes: a first winder 41, a second winder 42, a third winder 43, and a fourth winder 44. In certain embodiments, a roller shade fabric 2 is wound on the roller shade fabric winding shaft 1 forming an upper edge of the adjustable roller shade 100. The weight 6 is attached to a bottom of the roller shade fabric 2 forming a lower edge of the adjustable roller shade 100. The movable pulley 13 is fixedly attached to the roller shade fabric winding shaft 1. The upward lifting rope 31 loops around the movable pulley 13 at its bottom, and a downward pulling rope 32 loops around the movable pulley 13 at its top. Each of the upward lifting rope 31 and the downward pulling rope 32 includes a first end and a second end.

In certain embodiments, the first winder 41 and the second winder 42 are used to wind the first end and the second end of the upward lifting rope 31, respectively, and the third winder 43 and the fourth winder 44 are used to wind the first end and the second end of the downward pulling rope 32, respectively. These four winders rotate in concert to adjust the upper edge and the lower edge of the of the adjustable roller shade 100.

In certain embodiments, each of these winders is driven by a driving motor independently, and the driving motors are controlled by a controller 10. As shown in FIG. 3, the first winder 41 is driven by a first driving motor 91, the second winder 42 is driven by a second driving motor 92, the third winder 43 is driven by a third driving motor 93, and the fourth winder 44 is driven by a fourth driving motor 94. In one embodiment, the controller 10 receives control commands from a manual control device 16. In another embodiment, the controller 10 receives control commands from a control switch 17 attached to the window frame as shown in FIG. 1. In yet another embodiment, the controller 10 receives control commands from a remote control 18 as shown in FIG. 2.

In certain embodiments, the traction ropes 3 should have minimum stretchability. In one embodiment, the traction ropes 3 are nylon ropes. In another embodiment, the traction ropes 3 are bead chains. In yet another embodiment, the traction ropes 3 are belts.

In certain embodiments, when the first winder 41 and the third winder 43 rotate clockwise, and the second winder 42 and the fourth winder 44 rotate counter-clockwise, the upper edge of the adjustable roller shade 100 rises. When the first winder 41 and the third winder 43 rotate counter-clockwise, and the second winder 42 and the fourth winder 44 rotate clockwise, the upper edge of the adjustable roller shade 100 lowers. When the first winder 41, the second winder 42, the third winder 43 and the fourth winder 44 rotate clockwise, the lower edge of the adjustable roller shade 100 lowers. When the first winder 41, the second winder 42, the third winder 43 and the fourth winder 44 rotate counter-clockwise, the lower edge of the adjustable roller shade 100 rises.

In certain embodiments, as shown in FIG. 4, the adjustable roller shade 100 includes: a roller shade fabric winding shaft 1, a weight 6, a movable pulley 13, a pair of traction ropes 3, and a set of winders. The pair of traction ropes 3 includes an upward lifting rope 31 and a downward pulling rope 32. The set of winders includes: a first winder 41 and a third winder 43. In certain embodiments, a roller shade fabric 2 is wound on the roller shade fabric winding shaft 1 forming an upper edge of the adjustable roller shade 100. The weight 6 is attached to a bottom of the roller shade fabric 2 forming a lower edge of the adjustable roller shade 100. The movable pulley 13 is fixedly attached to an axial 14 and a driving motor 15 is installed on the axial 14 to drive the roller shade fabric winding shaft 1 to rotate clockwise to lower the lower edge of the adjustable roller shade 100, and to drive the roller shade fabric winding shaft 1 to rotate counter-clockwise to raise the lower edge of the adjustable roller shade 100.

In certain embodiments, the upward lifting rope 31 loops around the movable pulley 13 at its bottom, and a downward pulling rope 32 loops around the movable pulley 13 at its top. Each of the upward lifting rope 31 and the downward pulling rope 32 includes a first end and a second end.

In certain embodiments, the second end of the upward lifting rope 31 is fixedly attached to an upward lifting rope fixed point 45 and the second end of the downward pulling rope 32 is fixedly attached to a downward pilling rope fixed point 46. The first winder 41 is used to wind the first end of the upward lifting rope 31, and the third winder 43 is used to wind the first end of the downward pulling rope 32. These two winders 41 and 43 rotate in concert to adjust the upper edge and the lower edge of the of the adjustable roller shade 100.

In certain embodiments, each of these winders is driven by a driving motor independently, and the driving motors are controlled by a controller 10. As shown in FIG. 4, the first winder 41 is driven by a first driving motor 91, the third winder 43 is driven by a third driving motor 93. In one embodiment, the controller 10 receives control commands from a manual control device 16. In another embodiment, the controller 10 receives control commands from a control switch 17 attached to the window frame as shown in FIG. 1. In yet another embodiment, the controller 10 receives control commands from a remote control 18 as shown in FIG. 2.

In certain embodiments, the traction ropes 3 should have minimum stretchability. In one embodiment, the traction ropes 3 are nylon ropes. In another embodiment, the traction ropes 3 are bead chains. In yet another embodiment, the traction ropes 3 are belts.

In certain embodiments, when the first winder 41 and the third winder 43 rotate clockwise, the second ends of the upward lifting rope 31 and the downward pulling rope 32 remain stationary, the upper edge of the adjustable roller shade 100 rises. When the first winder 41 and the third winder 43 rotate counter-clockwise, the second ends of the upward lifting rope 31 and the downward pulling rope 32 remain stationary, the upper edge of the adjustable roller shade 100 lowers. When the driving motor 15 rotates clockwise, the driving motor 15 drives the roller shade fabric winding shaft 1 clockwise, the lower edge of the adjustable roller shade 100 lowers. When the driving motor 15 rotates counter-clockwise, the driving motor 15 drives the roller shade fabric winding shaft 1 counter-clockwise, the lower edge of the adjustable roller shade 100 rises.

Figure 5:
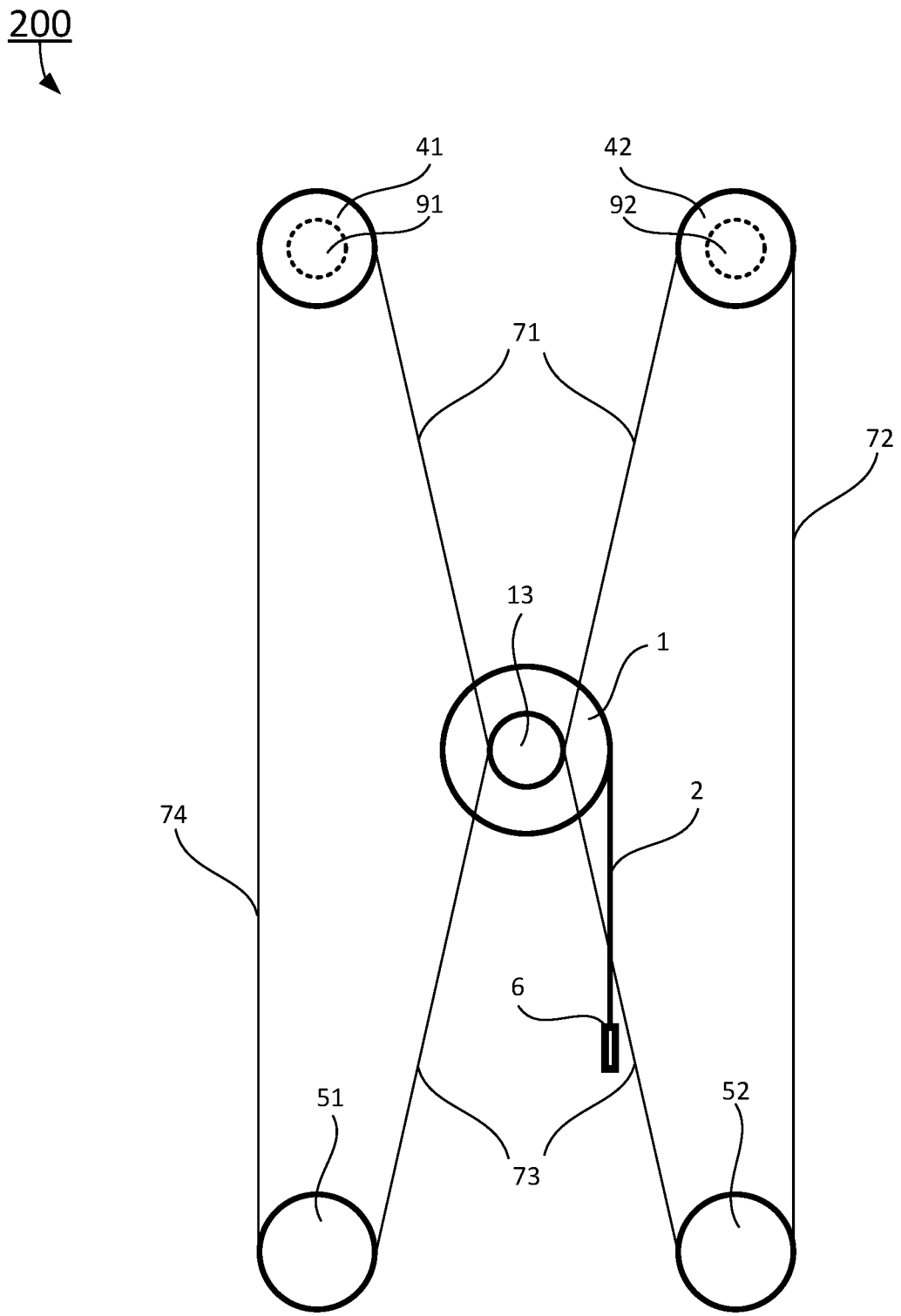
FIG. 5 illustrates an exemplary adjustable roller shade having one traction rope according to certain embodiments of the present disclosure.
Figure 6:
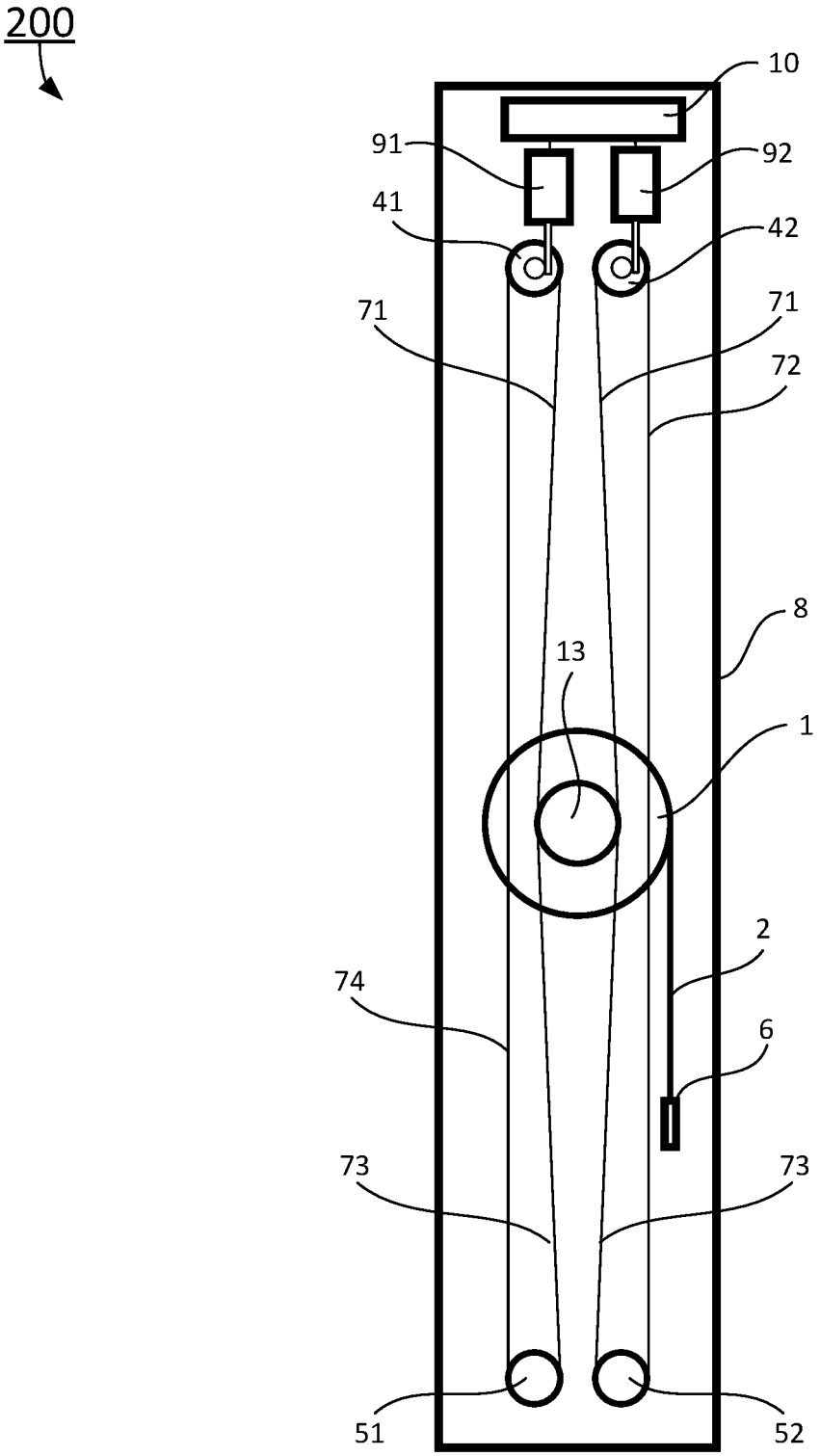
FIG. 6 illustrates an exemplary adjustable roller shade positioned inside guide grooves according to certain embodiments of the present disclosure.
Figure 7:
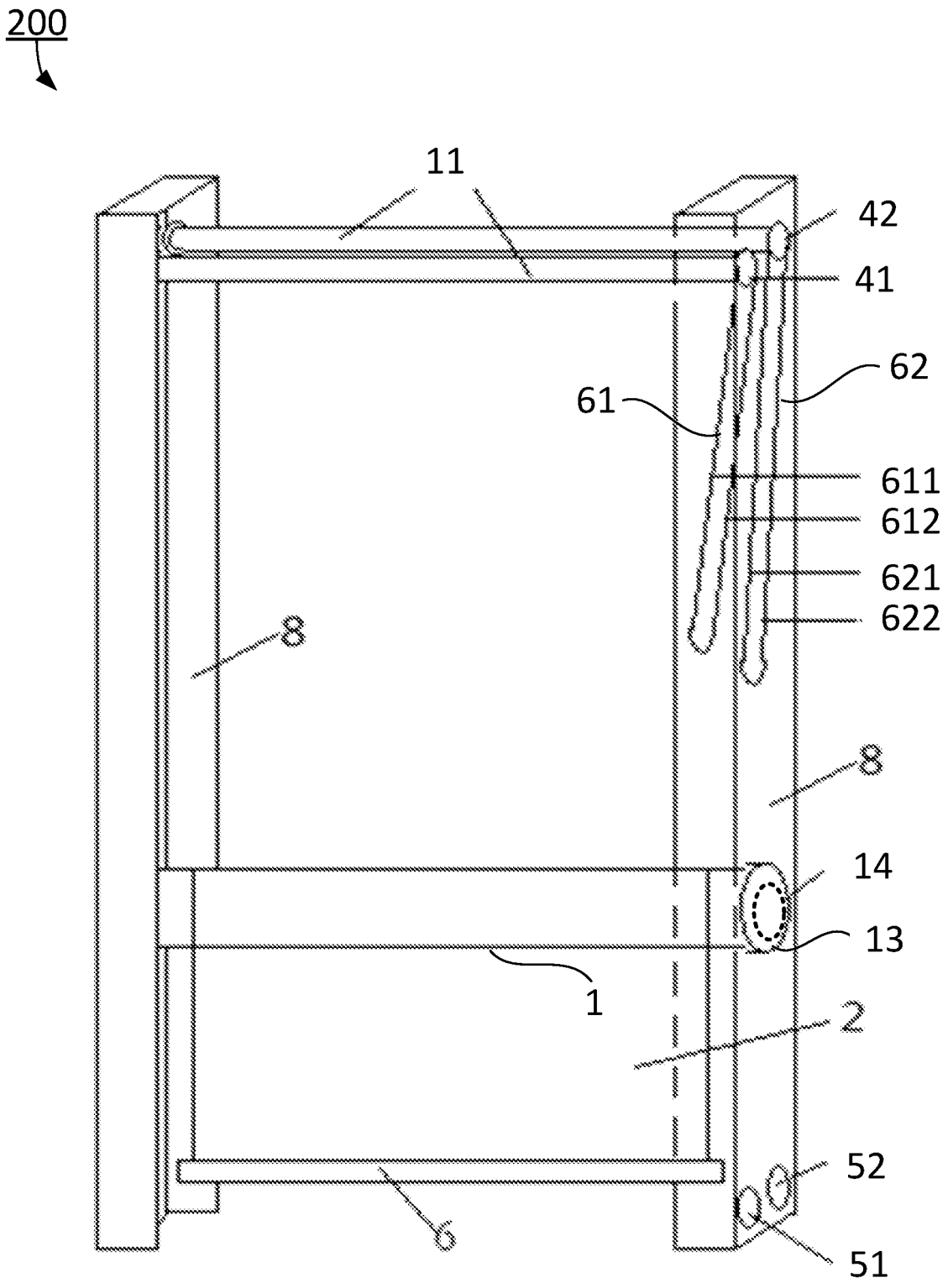
FIG. 7 is a schematic view of the overall installation structure of manually operated adjustable roller shade according to certain embodiments of the present disclosure.

In another aspect, as shown in FIGS. 5-7, the present disclosure relates to an adjustable roller shade 200. In certain embodiments, the adjustable roller shade 200 includes: a roller shade fabric winding shaft 1, a weight 6, a movable pulley 13, a traction rope 3, and a pair of winders. A roller shade fabric 2 is wound on the roller shade fabric winding shaft 1 forming an upper edge of the adjustable roller shade 200. A weight 6 is attached to a bottom of the roller shade fabric 2 forming a lower edge of the adjustable roller shade 200. The movable pulley 13 is fixedly attached to a first end of the roller shade fabric winding shaft 1. The traction rope 3 is wound around the movable pulley 13. The traction rope 3 includes an upward lifting section 71, a first connecting section 72, a downward pulling section 73, and a second connecting section 74 forming a closed loop. The pair of winders includes a first winder 41, and a second winder 42. The upward lifting section 71 goes from the first winder 41, under the movable pulley 13, and to the second winder 42, the downward pulling section 73 goes from a second tensioning wheel 52, over the movable pulley 13, and to a first tensioning wheel 51, a first connecting section 72 connects a first end of the upward lifting section 71 to a first end of the downward pulling section 73, and a second connecting section 74 connects a second end of the downward pulling section 73 to a second end of the upward lifting section 71.

In certain embodiments, the traction rope 3 should have minimum stretchability. In one embodiment, the traction rope 3 is a nylon rope. In another embodiment, the traction rope 3 is a bead chain. In yet another embodiment, the traction rope 3 is a belt.

Each of the pair of winders is driven by a driving motor independently, and the driving motors are controlled by a controller 10 (not shown in FIG. 5). As shown in FIGS. 5 and 6, the first winder 41 is driven by a first driving motor 91, and the second winder 42 is driven by a second driving motor 92. In one embodiment, the controller 10 receives control commands from a manual control device 16. In another embodiment, the controller 10 receives control commands from a control switch 17 attached to the window frame as shown in FIG. 1. In yet another embodiment, the controller 10 receives control commands from a remote control 18 as shown in FIG. 2.

In certain embodiments, as shown in FIG. 7, the manual control device 16 includes a first bead chain 61 linked to the first winder 41, and a second bead chain 62 linked to the second winder 42. The first bead chain 61 includes: a first upward lifting section 611, a first downward pulling section 612. The second bead chain 62 includes: a second upward lifting section 621, and a second downward pulling section 622.

In certain embodiments, when the first winder 41 rotates clockwise, and the second winder rotates counter-clockwise, the upper edge of the adjustable roller shade 200 lowers. When the first winder 41 rotates counter-clockwise, and the second winder rotates clockwise, the upper edge of the adjustable roller shade 200 rises. When the first winder 41 and the second winder 42 rotate clockwise, the lower edge of the adjustable roller shade 200 lowers. When the first winder 41 and the second winder 42 rotate counter-clockwise, the lower edge of the adjustable roller shade 200 rises.

In certain embodiments, as shown FIG. 7, a second movable pulley 13 is fixedly attached to a second end of the roller shade fabric winding shaft 1, a second traction rope 3 goes through a second pair of winders 41 and 42 and a pair of tensioning wheels 51 and 52 on the second end of the roller shade fabric winding shaft 1, both movable pulleys 13, two pairs of winders 41 and 42, and two pairs of tensioning wheels 51 and 52 are installed in two guide grooves 8 located on each end of the roller shade fabric winding shaft 1, symmetrically to maintain balance of the adjustable roller shade 200. The first driving motor 91 and the second driving motor 92 are installed on one side of the guide grooves 8, and the second pair of winders 41 and 42 are driven by a pair of transmission rods 11.

Figure 8:
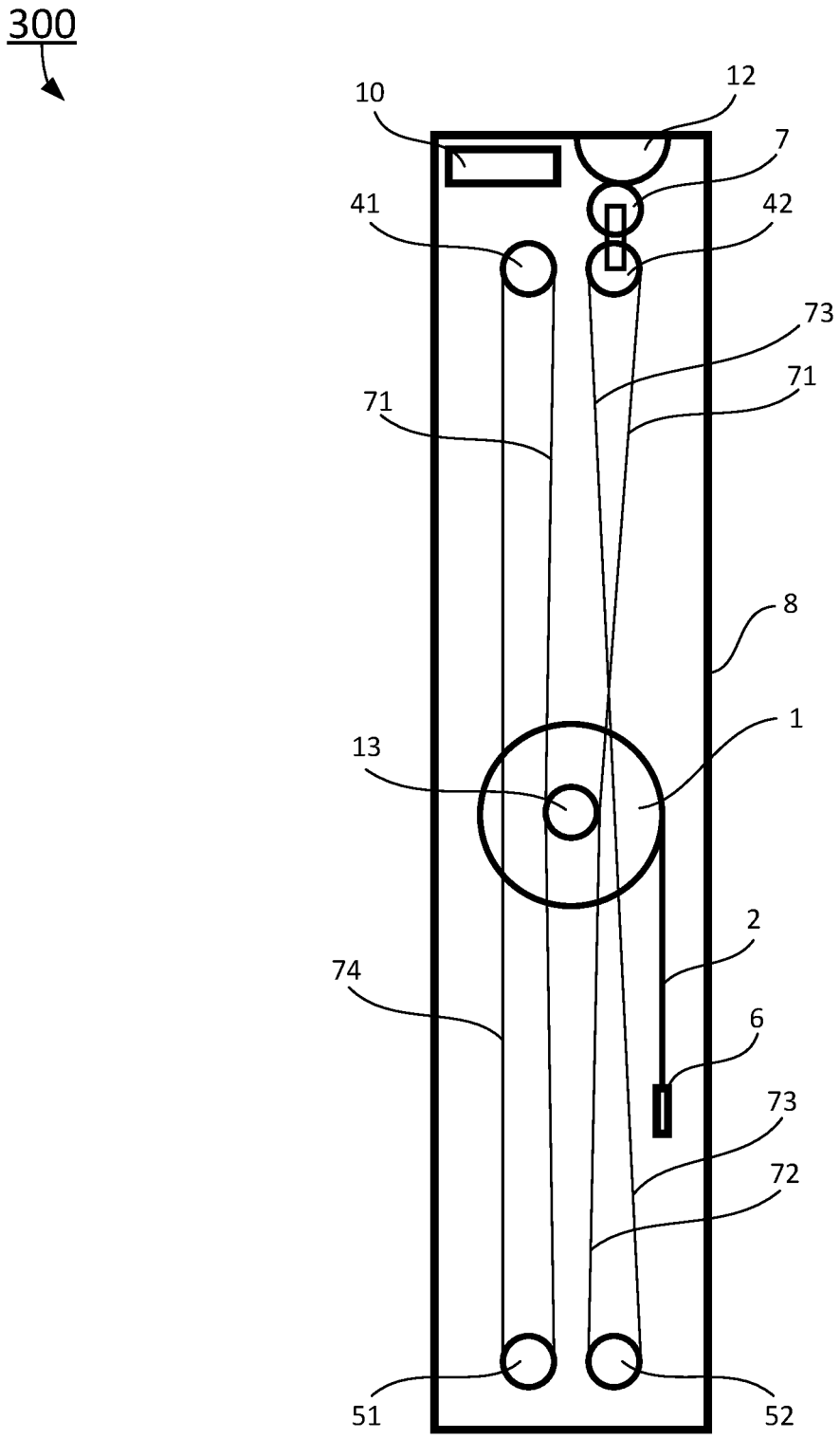
FIG. 8 illustrates an exemplary adjustable roller shade having driving gear set and a disengaged clutch device according to certain embodiments of the present disclosure.
Figure 9:
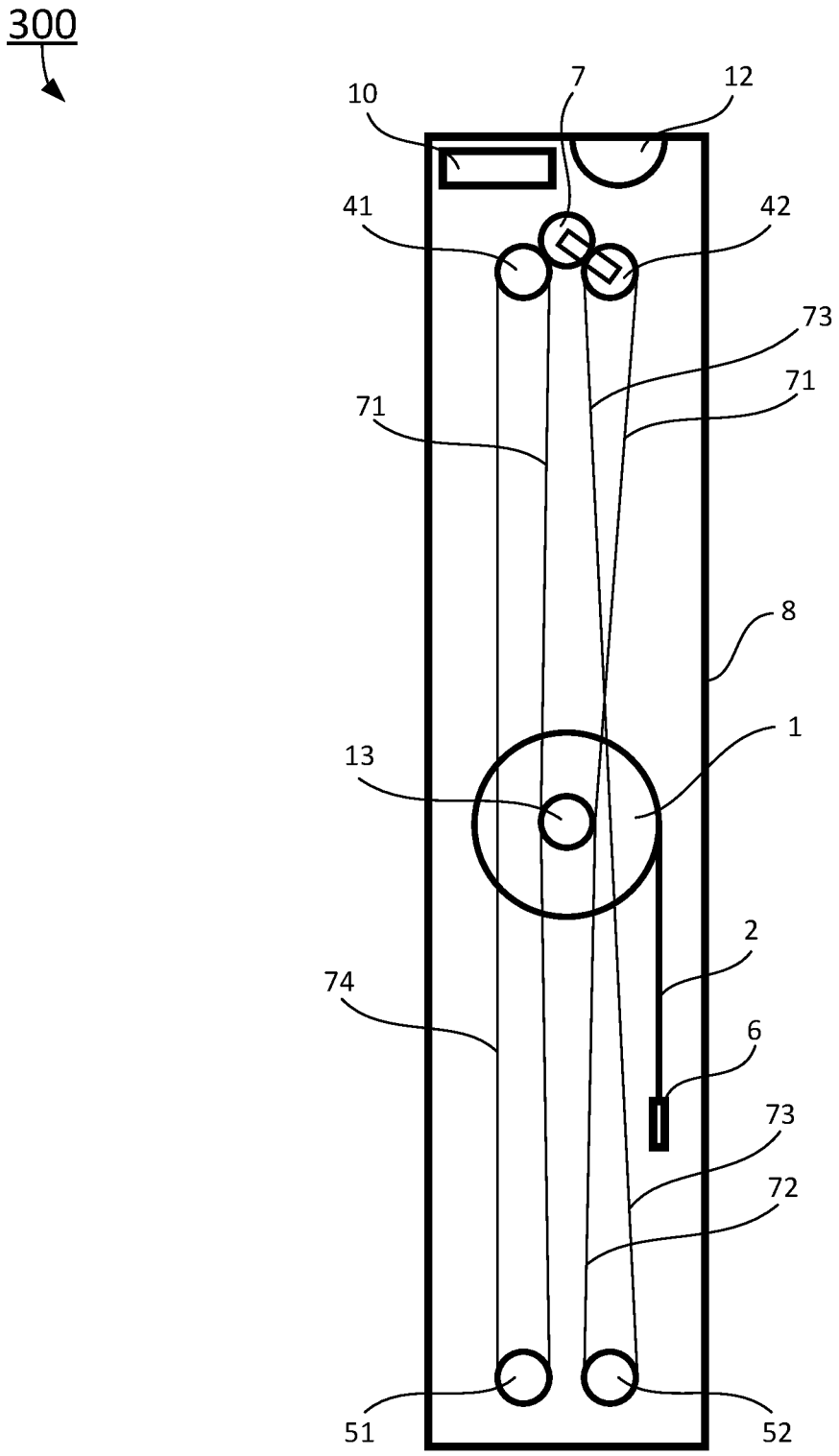
FIG. 9 illustrates an exemplary adjustable roller shade having driving gear set and an engaged clutch device according to certain embodiments of the present disclosure.
Figure 10:
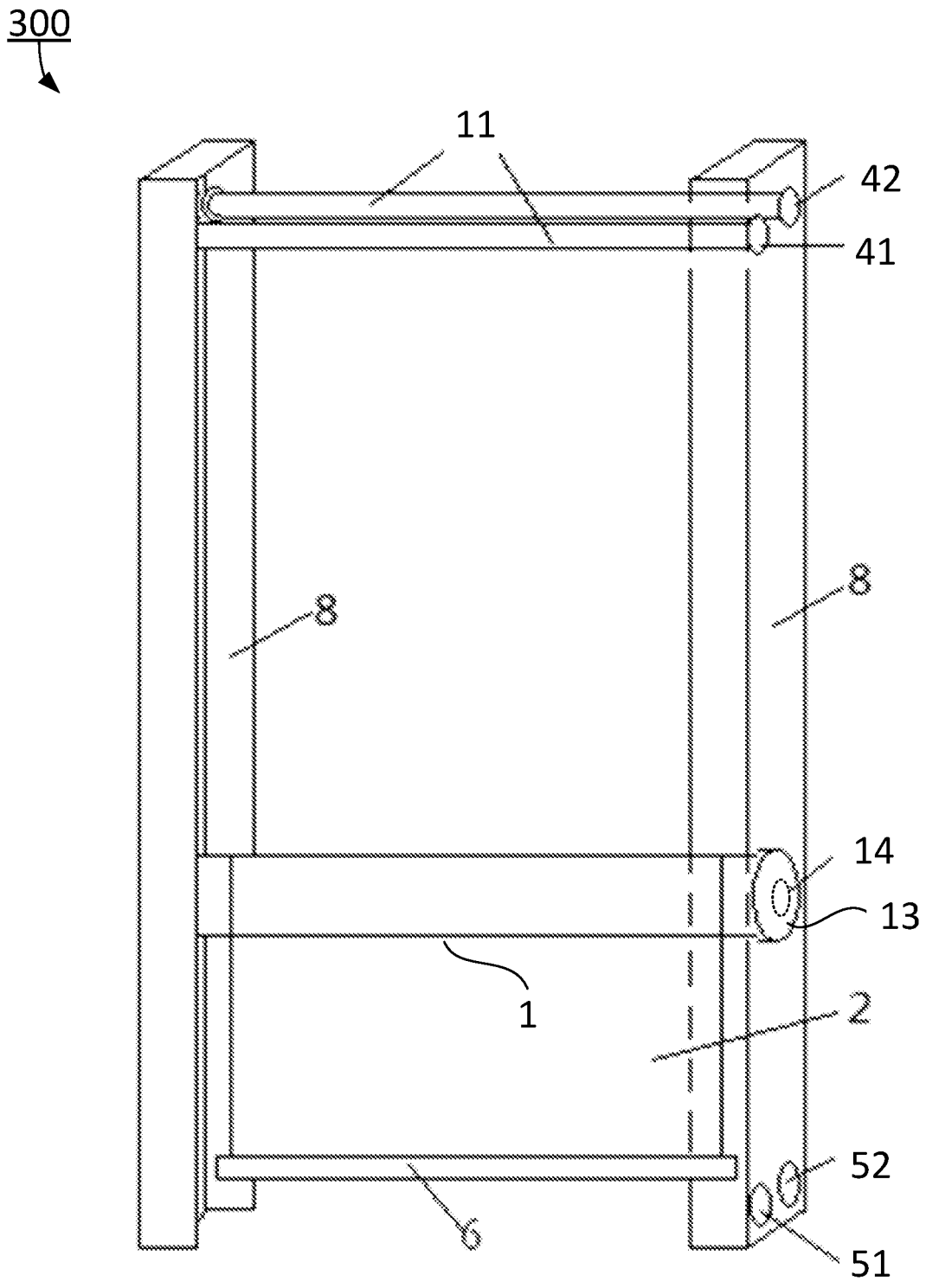
FIG. 10 is a schematic view of the overall installation structure of adjustable roller shade according to certain embodiments of the present disclosure.

In yet another aspect, as shown in FIGS. 8-10, the present disclosure relates to an adjustable roller shade 300. In certain embodiments, the adjustable roller shade 300 includes: a roller shade fabric winding shaft 1, a weight 6, a movable pulley 13, a traction rope 3, and a pair of winders. A roller shade fabric 2 is wound on the roller shade fabric winding shaft 1 forming an upper edge of the adjustable roller shade 300. The weight 6 is attached to a bottom of the roller shade fabric 2 forming a lower edge of the adjustable roller shade 300. The movable pulley 13 is fixedly attached to a first end of the roller shade fabric winding shaft 1. The traction rope 3 is wound around the movable pulley 13. The traction rope 3 includes an upward lifting section 71, a first connecting section 72, a downward pulling section 73, and a second connecting section 74 forming a closed loop. The pair of winders includes a first winder 41, and a second winder 42. A first end of the upward lifting section 71 goes from the first winder 41, under the movable pulley 13, and to the second winder 42, connects a first end of the downward pulling section 73, goes around a second tensioning wheel 52, connects to a first end of a first connecting section 72, goes over the movable pulley 13, connects to a first end of a second connecting section 74 around the first tensioning wheel 51, and connects the first end of the upward lifting section 71, forming a complete loop.

In certain embodiments, the traction rope 3 should have minimum stretchability. In one embodiment, the traction rope 3 is a nylon rope. In another embodiment, the traction rope 3 is a bead chain. In yet another embodiment, the traction rope 3 is a belt.

The pair of winders 41 and 42 are driven by a driving gear set 12 and a clutch device 7. The driving gear set 12 and the clutch device 7 are controlled by a controller 10. In one embodiment, the controller 10 receives control commands from a manual control device 16. In another embodiment, the controller 10 receives control commands from a control switch 17 attached to the window frame as shown in FIG. 1. In yet another embodiment, the controller 10 receives control commands from a remote control 18 as shown in FIG. 2.

In certain embodiments, as shown in FIG. 8, when the first winder 41 is disengaged with the clutch device 7, and when the second winder 42 is driven to rotates clockwise by the driving gear set 12 through the clutch device 7, the upper edge of the adjustable roller shade 300 lowers. When the first winder 41 is disengaged with the clutch device 7, and when the second winder 42 is driven to rotates counter-clockwise by the driving gear set 12 through the clutch device 7, the upper edge of the adjustable roller shade 300 rises.

In certain embodiments, as shown in FIG. 9, when the first winder 41 is engaged with the clutch device 7, and when the second winder 42 is driven to rotates clockwise by the driving gear set 12 through the clutch device 7, the first winder 41 also rotates clockwise causing the roller shade fabric winding shaft 1 to rotate clockwise, and the lower edge of the adjustable roller shade 300 lowers. When the first winder 41 is engaged with the clutch device 7, and when the second winder 42 is driven to rotates counter-clockwise by the driving gear set 12 through the clutch device 7, the first winder 41 also rotates counter-clockwise causing the roller shade fabric winding shaft 1 to rotate counter-clockwise, and the lower edge of the adjustable roller shade 300 rises.

In certain embodiments, as shown in FIG. 10, a second movable pulley 13 is fixedly attached to a second end of the roller shade fabric winding shaft 1, a second traction rope 3 goes through a second pair of winders 41 and 42 and a pair of tensioning wheels 51 and 52 on the second end of the roller shade fabric winding shaft 1, both movable pulleys 13, two pairs of winders 41 and 42, and two pairs of tensioning wheels 51 and 52 are installed in two guide grooves 8 located on each end of the roller shade fabric winding shaft 1, symmetrically to maintain balance of the adjustable roller shade 300, and the driving gear set 12 and the clutch device 7 are installed on one side of the guide grooves 8, the second pair of winders 41 and 42 are driven by a pair of transmission rods 11.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope. Accordingly, the scope of the present disclosure is defined by the appended claims rather than the foregoing description and the exemplary embodiments described therein.

What is claimed is:

1. An adjustable roller shade, comprising:

a roller shade fabric winding shaft, wherein a roller shade fabric wound on the roller shade fabric winding shaft forms an upper edge of the adjustable roller shade;

a weight attached to a bottom of the roller shade fabric forming a lower edge of the adjustable roller shade;

a movable pulley fixedly attached to a first end of the roller shade fabric winding shaft;

a traction rope wound around the movable pulley, wherein the traction rope comprises an upward lifting section, a first connecting section, a downward pulling section, and a second connecting section forming a closed loop; and a first winder and a second winder, wherein the upward lifting section goes from the first winder, under the movable pulley, and to the second winder, the downward pulling section goes from a second tensioning wheel, over the movable pulley, and to a first tensioning wheel, the first connecting section connects the upward lifting section to the downward pulling section, and the second connecting section connects the downward pulling section to the upward lifting section.

2. The adjustable roller shade according to claim 1, wherein the traction rope comprises: a rope, or a bead chain, or a belt, or combinations thereof.

3. The adjustable roller shade according to claim 1, wherein each of the first winder and the second winder is driven by a first driving motor and a second driving motor, respectively, and the first driving motor and the second driving motor are controlled by a controller.

4. The adjustable roller shade according to claim 3, wherein the controller receives control commands from a control device, and the control device comprises: a manual control device, or a control switch, or a remote control, or combinations thereof.

5. The adjustable roller shade according to claim 4, wherein the manual control device comprises a first bead chain linked to the first winder, and a second bead chain linked to the second winder, wherein the first bead chain includes: a first upward lifting section, a first downward pulling section, and the second bead chain includes: a second upward lifting section, and a second downward pulling section.

6. The adjustable roller shade according to claim 5, wherein when the first winder rotates clockwise, and the second winder rotates counter-clockwise, the upper edge of the adjustable roller shade lowers;

when the first winder rotates counter-clockwise, and the second winder rotates clockwise, the upper edge of the adjustable roller shade rises;

when the first winder and the second winder rotate clockwise, the lower edge of the adjustable roller shade lowers; and when the first winder and the second winder rotate counter-clockwise, the lower edge of the adjustable roller shade rises.

7. The adjustable roller shade according to claim 1, wherein a second movable pulley is fixedly attached to a second end of the roller shade fabric winding shaft;

a second traction rope goes through a third winder and a fourth winder and a third tensioning wheel and a fourth tensioning wheel on the second end of the roller shade fabric winding shaft;

the movable pulley, the first winder and the second winder, the first tensioning wheel and the second tensioning wheel are installed in a first guide groove located on the first end of the roller shade fabric winding shaft, the second movable pulley, the third winder and the fourth winder, the third tensioning wheel and the fourth tensioning wheel are installed in a second guide groove located on the second end of the roller shade fabric winding shaft, respectively, and symmetrically to maintain balance of the adjustable roller shade; and the first driving motor and the second driving motor are installed on one side of the guide grooves, the third winder and the fourth winder are driven by a first transmission rod and a second transmission rod, respectively.

* * * * *